US007980417B2

(12) United States Patent
Riley

(10) Patent No.: US 7,980,417 B2
(45) Date of Patent: Jul. 19, 2011

(54) THEFT RESISTANT PRODUCT MERCHANDISER

(75) Inventor: Daniel C. Riley, Hackensack, NJ (US)

(73) Assignee: Display Technologies, College Point, NY (US)

( * ) Notice: Subject to any disclaimer, the term of this patent is extended or adjusted under 35 U.S.C. 154(b) by 380 days.

(21) Appl. No.: 11/980,970

(22) Filed: Oct. 31, 2007

(65) Prior Publication Data

US 2009/0108014 A1 Apr. 30, 2009

Related U.S. Application Data

(63) Continuation of application No. PCT/US2005/014900, filed on Apr. 29, 2005.

(60) Provisional application No. 60/566,860, filed on Apr. 30, 2004.

(51) Int. Cl.
*G07F 9/02* (2006.01)
*G07F 9/00* (2006.01)

(52) U.S. Cl. ..... 221/3; 221/67; 221/277

(58) Field of Classification Search ..... 221/2–4, 221/67, 154, 175–177, 191, 194, 208, 246–249, 221/255–257, 261, 263–265, 268, 276, 277, 221/281, 288, 303
See application file for complete search history.

(56) References Cited

U.S. PATENT DOCUMENTS

| | | | | | |
|---|---|---|---|---|---|
| 772,226 | A | * | 10/1904 | Disbrow | 221/245 |
| 1,333,479 | A | * | 3/1920 | Farmer | 221/256 |
| 1,361,386 | A | * | 12/1920 | Kalamen | 446/413 |
| 2,339,781 | A | * | 1/1944 | Hurwitz | 222/39 |
| 2,521,458 | A | * | 9/1950 | Huheey et al. | 221/125 |
| 2,711,241 | A | * | 6/1955 | Abrahamsen | 193/38 |
| 2,977,023 | A | * | 3/1961 | Meyer | 221/205 |
| 3,161,321 | A | * | 12/1964 | Mellion et al. | 221/266 |
| 3,743,137 | A | * | 7/1973 | Bennett | 221/289 |
| 3,923,159 | A | * | 12/1975 | Taylor et al. | 211/159.2 |
| 4,146,122 | A | * | 3/1979 | Harris | 194/253 |
| 4,257,324 | A | * | 3/1981 | Stefansson et al. | 101/93.01 |
| 4,577,780 | A | * | 3/1986 | Holland et al. | 221/125 |
| 4,586,633 | A | * | 5/1986 | Holland et al. | 221/257 |
| 4,712,712 | A | * | 12/1987 | Garden | 221/68 |
| 4,809,879 | A | * | 3/1989 | Hanley | 221/125 |
| 4,852,767 | A | * | 8/1989 | Humphrey | 221/241 |

(Continued)

FOREIGN PATENT DOCUMENTS

EP 1329179 A1 1/2002

(Continued)

*Primary Examiner* — Gene Crawford
*Assistant Examiner* — Kelvin L Randall, Jr.
(74) *Attorney, Agent, or Firm* — Carter, DeLuca, Farrell & Schmidt, LLP

(57) ABSTRACT

A product merchandiser stores a plurality of products, dispenses products one at a time and produces a sound when a product is dispensed. The product merchandiser may include a housing, a track, a door and a structure that produces sound. The housing has a proximal opening. The track may be disposed within the housing and directs products towards the proximal opening of the housing. The door is disposed near the proximal opening of the housing. The door pivotally connects to the housing and is movable from a first position to at least a second position. When the door is in its first position, a product is held at least partially within the housing. When the door is in its second position, a product is removable from the housing. The sound-producing structure produces a sound when the door is moved between its first position and its second position.

19 Claims, 6 Drawing Sheets

U.S. PATENT DOCUMENTS

| | | | | |
|---|---|---|---|---|
| 4,887,737 | A * | 12/1989 | Adenau | 221/3 |
| 5,247,798 | A * | 9/1993 | Collard, Jr. | 62/3.62 |
| 5,356,033 | A * | 10/1994 | Delaney | 221/194 |
| 5,396,997 | A * | 3/1995 | Johnson | 211/59.2 |
| 5,397,025 | A * | 3/1995 | Lee | 221/299 |
| 5,462,198 | A * | 10/1995 | Schwimmer | 221/130 |
| 5,788,117 | A * | 8/1998 | Zimmanck | 221/285 |
| 6,109,059 | A * | 8/2000 | Lebrun | 62/457.5 |
| 6,142,644 | A * | 11/2000 | Leung | 362/98 |
| 6,173,582 | B1 * | 1/2001 | Hixson | 62/457.4 |
| 6,206,237 | B1 * | 3/2001 | Dillon et al. | 221/289 |
| 7,114,619 | B2 * | 10/2006 | Ellis et al. | 206/540 |
| 7,513,390 | B2 * | 4/2009 | Artsiely | 221/152 |
| 7,641,072 | B1 * | 1/2010 | Vlastakis et al. | 221/123 |
| 2005/0189369 | A1 * | 9/2005 | Vlastakis et al. | 221/123 |
| 2006/0131320 | A1 * | 6/2006 | Nagelski et al. | 221/67 |
| 2008/0142538 | A1 * | 6/2008 | Miller | 221/154 |
| 2008/0245813 | A1 * | 10/2008 | Johnson et al. | 221/194 |

FOREIGN PATENT DOCUMENTS

| | | |
|---|---|---|
| GB | 2247068 A | 2/1992 |

* cited by examiner

THEFT RESISTANT PRODUCT MERCHANDISER

CROSS-REFERENCE TO RELATED APPLICATION

This application is a continuation of International Application No. PCT/US2005/014900 filed on Apr. 29, 2005, which claims the benefit of and priority to Provisional Application No. 60/566,860 filed on Apr. 30, 2004.

BACKGROUND

1. Technical Field

The present disclosure relates generally to product merchandisers which store, display and dispense products one at a time. More particularly, the present disclosure relates to a product merchandiser having a security device which protects products therein from theft.

2. Description of the Related Art

The prior art includes a vast number of structures for storing, displaying and dispensing products of all kinds and sizes. In stores and supermarkets where space is at a premium, product merchandisers are generally configured to hold a plurality of products in vertical columns or in horizontal rows. These merchandisers may be tilted for gravity feed or they may have continuous, serpentine paths for merchandise stored in columns and rows to follow.

When products dispensed are cylindrical cans, the merchandiser apparatus will often utilize a gravity-feed serpentine path, which easily and economically delivers the cans and without the need for internal pusher elements. The main requirement would be structure at the opening or discharge area to prevent products from falling out, and to allow one product at a time to reach the dispensing area.

Store owners who use product merchandisers of this type have found a disturbing amount of theft of certain particularly popular and/or expensive products. In supermarkets and other large stores it can be difficult or unreasonably expensive to monitor and guard these theft-prone dispensing machines.

The present disclosure addresses the theft problem with a modified merchandiser structure that alerts store staff when a product is being taken from the merchandiser. In view of honest customers who intend to pay for merchandise being in the vast majority, the present disclosure addresses the potential theft situation without embarrassing or offending honest customers.

SUMMARY

The present disclosure is directed to a product merchandiser which is useful in reducing the likelihood of theft. The merchandiser stores a plurality of products and dispenses products one at a time. The product merchandiser includes a housing, a track, a door and a structure that produces sound. The housing has a proximal opening disposed thereon. The track is disposed within the housing and it directs products towards proximal opening of the housing. The door has a proximal portion and a distal portion and is disposed near the proximal opening of the housing. The door pivotally connects to the housing and is movable from a first position to at least a second position. When the door is in its first position, a product is held at least partially within the housing. When the door is in its second position, a product is removable from the housing. The sound-producing structure produces a sound when the door is moved between its first position and its second position. This sound may alert a store employee or other shoppers that an item is being dispensed from the product merchandiser, thus reducing the likelihood that a person would quickly remove multiple products from the dispenser, one at a time.

In one embodiment, the structure which produces a sound includes a ratcheting interface associated with the door and the housing. In this embodiment, as the door is opened (moved towards its second position), a structure on the door engages a structure on the housing and creates a ratcheting sound. A sound will occur each time the door is opened.

In one embodiment, the structure which produces a sound includes an elongated leaf spring which may be connected to the door and to the housing. When the door is in its first position, the leaf spring is generally straight and flat, as opposed to being flexed and stressed. When the door moves towards its second position, the leaf spring is axially compressed until it snaps into a bent configuration. From this snapping action and/or from the leaf spring striking the housing, a noise results. When the door is returned to its first position, the leaf spring returns to its generally straight and flat orientation. The noise will occur each time the door is opened.

In one embodiment, the door includes a holding portion disposed near its distal portion. The holding portion is dimensioned and configured to hold a lead product at least partially within housing. The door may also include a handle disposed near its proximal portion. The holding portion is configured such that when a user opens the door (moves it towards its second position), possibly via handle, the product in the holding portion is placed in a removable position.

In a particularly useful embodiment, the track directs a product onto the holding portion of the door. In such an embodiment, the door and track are positioned such that products traveling along the track are automatically directed to the holding portion of the door. The holding portion of the door may be configured to hold only one product. Further, when the door is moved from its first position to its second position, the distal portion of the door rises and blocks the next product in line from moving proximally. Additionally, while the door is in its second position, the next product in line cannot be forced (e.g. by a thief) onto the door or out of the product dispenser without the door returning to its first position. Therefore, the anti-theft features of the product merchandiser prevent a thief from removing a plurality of products from the product merchandiser while only creating a single sound. It is also envisioned for a stop tab to be included to further prevent the next product in line from being removable from product merchandiser without returning door to its first position.

It is envisioned for the door to be biased towards its first position, such that when a product is removed from holding portion, the door moves back to its first position and the next product is directed onto the holding portion. These feature facilitates products to be removed one at a time from the product merchandiser.

In one embodiment, the track in the housing forms a serpentine path, directing products towards the proximal opening of the housing. The serpentine path allows a plurality of products to be stored on product merchandiser while taking up a limited amount of space.

In one embodiment, the products within the housing are not directed by a track. Products in this embodiment are held within the housing and each product tumbles towards the proximal opening of the housing when a lead product is removed. In such an embodiment, gravity will direct the products downward and the distal wall of the housing will prevent the products from moving distally. Thus, the products will gravitate towards the proximal opening of the housing. It this embodiment, the lower portion of the housing may be sloped downwardly to facilitate the product flow within the housing.

It is envisioned for the housing to have a locking assembly operatively engaged with it. The locking assembly allows access to the interior (track, products) of the product merchandiser via a front portion of the housing, while preventing unauthorized access to the contents of the product merchandiser. A store employee will be able to open the lock and thereby access the interior of the product merchandiser, thus allowing him or her to load the product merchandiser with products, for example. Additionally, the lock may prevent thieves from taking several products at a time by bypassing the anti-theft aspects of the present disclosure.

BRIEF DESCRIPTION OF THE DRAWINGS

Embodiments of the present disclosure are described hereinbelow with reference to the drawings wherein.

DETAILED DESCRIPTION

Figure 1:
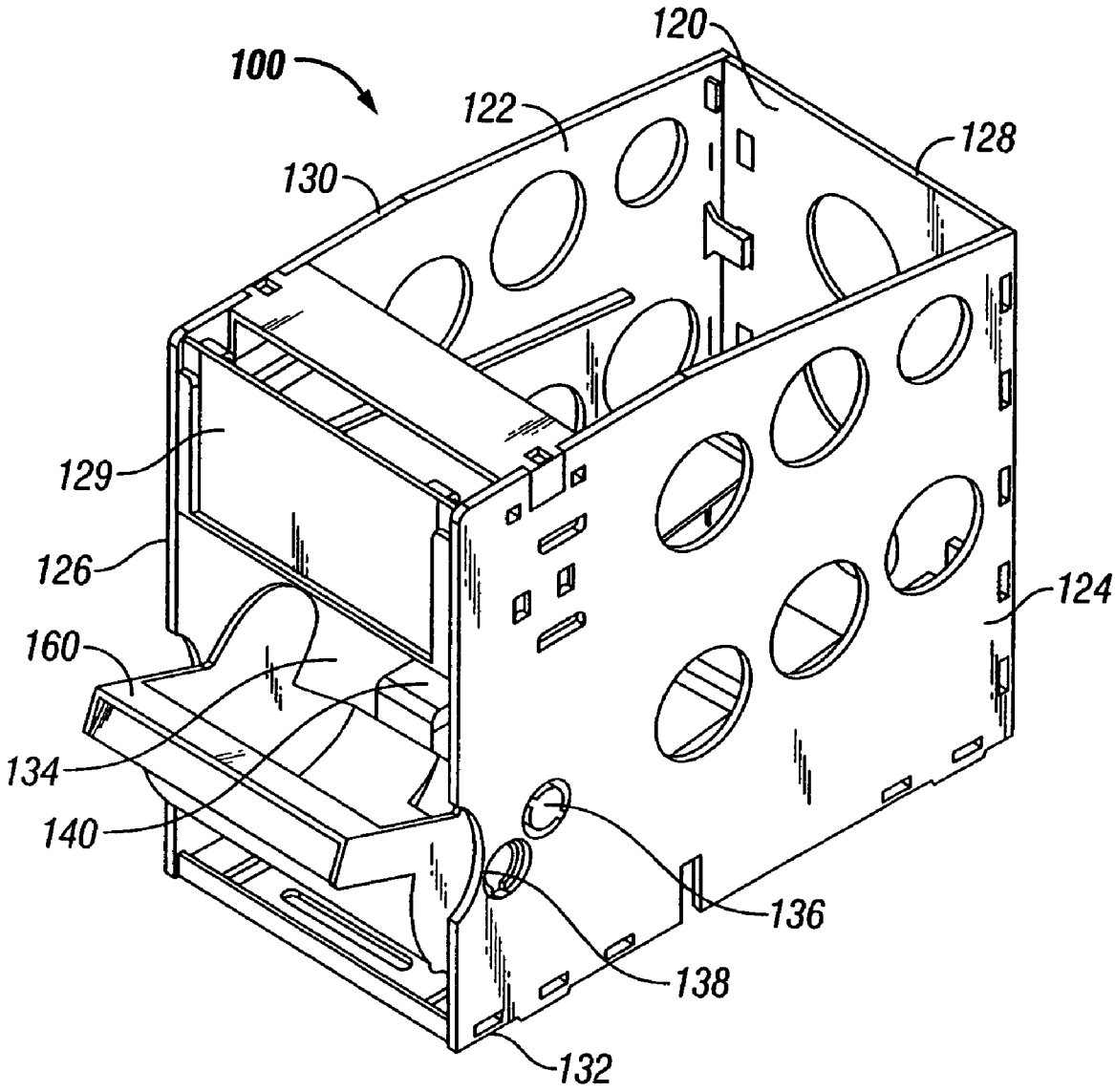
FIG. 1 is a perspective view of the product merchandiser of the present disclosure.

The product merchandiser of the present disclosure is illustrated in FIGS. 1-4D and is generally referred to by reference numeral 100. Product merchandiser 100 dispenses products, generally referred to by reference numeral 200, one at a time and emits an audible signal each time a product is dispensed. In the drawings and in the descriptions which follow, the term "proximal," as is traditional, will refer to the end of the product merchandiser which is closer to the user, while the term "distal" will refer to the end which is farther from the user. The embodiment illustrated in the drawings has been designed to accommodate a product of a particular shape, however, the principles of this product merchandiser are applicable for dispensing articles of many other shapes.

Product merchandiser 100 is used to reduce the likelihood that products 200 will be stolen from a store. To steal several products 200 from a store, as thieves typically do, a thief would have to dispense each product 200, one at a time, from product merchandiser 100. Each time a product 200 is dispensed, a noise would occur, alerting store clerks and customers that a product 200 was being dispensed. Thus, when several products 200 are consecutively dispensed, several noises would consecutively occur, leading to suspicion in the minds of store clerks and other customers.

The product merchandiser 100 of an embodiment of the present disclosure includes a housing 120, a track 140 (or series of tracks), a door 160 and a sound-producing structure 180. These elements of the product merchandiser 100 mutually cooperate to dispenses products 200 one at a time from product merchandiser 100 while making a sound each time a product 200 is moved towards and/or reaches a removable position.

The housing 120 may have a general rectangular shape, including side walls 122, 124 or any other suitable shape for holding a plurality of products 200. The housing 120 also includes a proximal portion 126, a distal portion 128, an upper portion 130 and a lower portion 132. An opening 134 exists near proximal portion 126 and lower portion 132 of housing 120 (a single opening).

A track 140 may be disposed within housing 120 and forms a path for products 200 to follow. The track 140 generally extends inward from side walls 122, 124 and slopes towards the lower portion 132 of housing 120. This sloping of track 140 enables products 200 being stored thereon to be gravity fed towards opening 134 of housing 120. FIGS. 4A-4D illustrate a plurality of products 200 in a serpentine path created by series of tracks 140. It is within the scope of this disclosure for the housing 120 to extend vertically and/or horizontally, thus enabling the product merchandiser 100 to store more products 200 than those illustrated in the accompanying figures. Additionally, the track 140 may be configured to direct a product 200 onto a holding portion 166 of the door 160 (discussed below).

Figure 8:
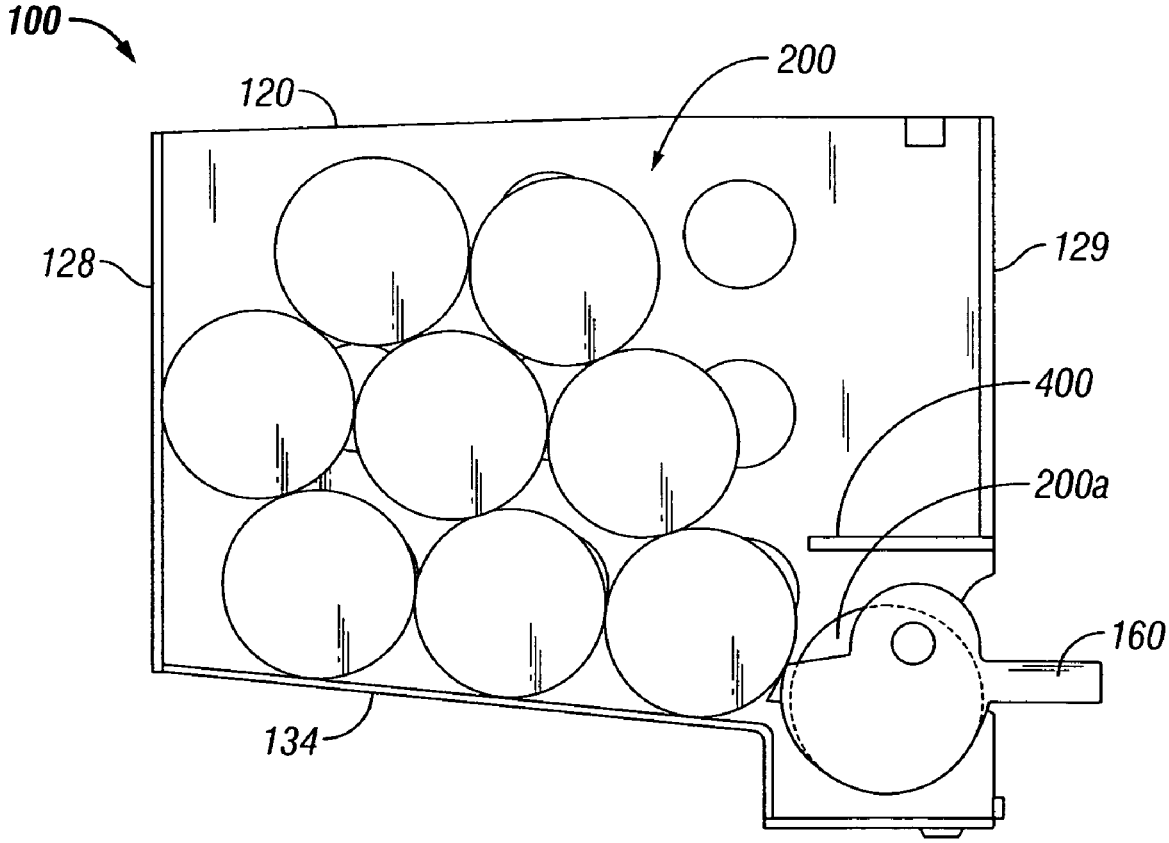
FIG. 8 is a side view of the product merchandiser illustrated without tracks.

In the embodiment illustrated in FIG. 8, there is no track to direct the products 200 within the housing 120. Rather the products 200 are stored in the housing 120 in a stacked fashion. Products 200 in this embodiment are held within the housing and each product 200 tumbles towards the proximal opening 134 of the housing 120 when the lead product 200*a* is removed. In such an embodiment, gravity will direct the products 200 downward and the distal wall 128 of the housing 120 will prevent the products 200 from moving distally. Thus, the products 200 will gravitate towards the proximal opening 134 of the housing 120. It this embodiment, the lower portion 132 of the housing 120 may be sloped downwardly to facilitate the product flow within the housing 120. A lip 400 may be disposed above proximal opening 134 to prevent a thief from reaching into housing 120 in an attempt to bypass the security features of the product merchandiser 100.

Figure 4A:
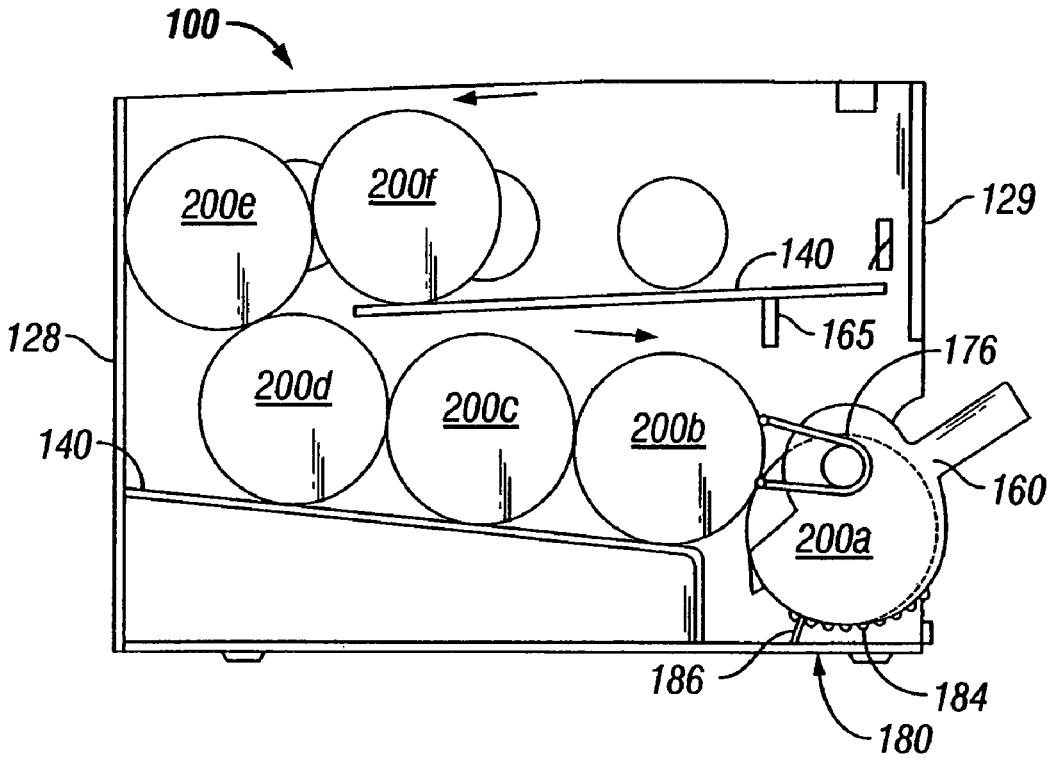
FIGS. 4A-4D are side views of the product merchandiser of FIG. 1 illustrated with a plurality of products therein.
Figure 4B:
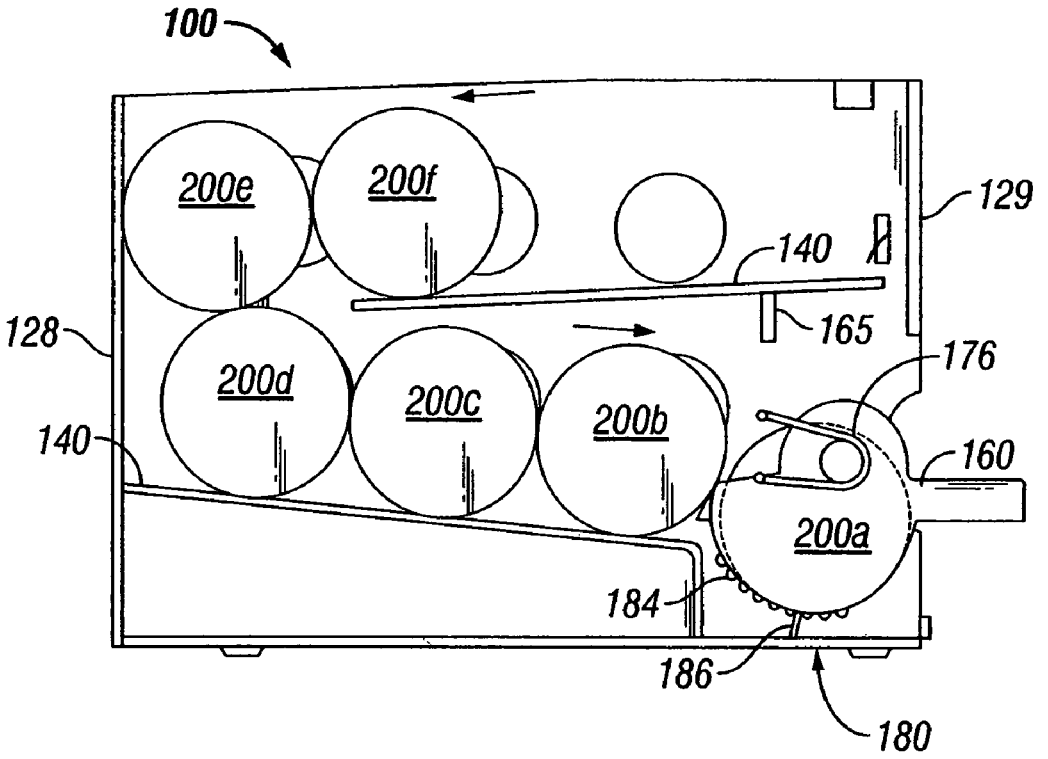
Figure 4C:
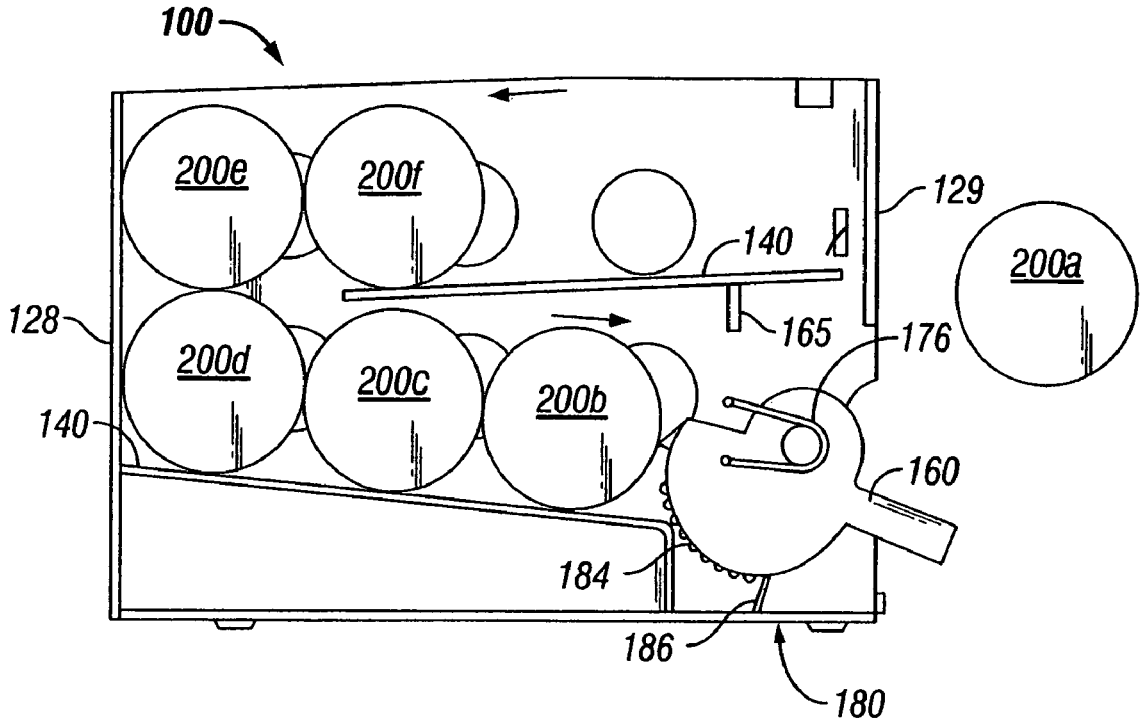
Figure 4D:
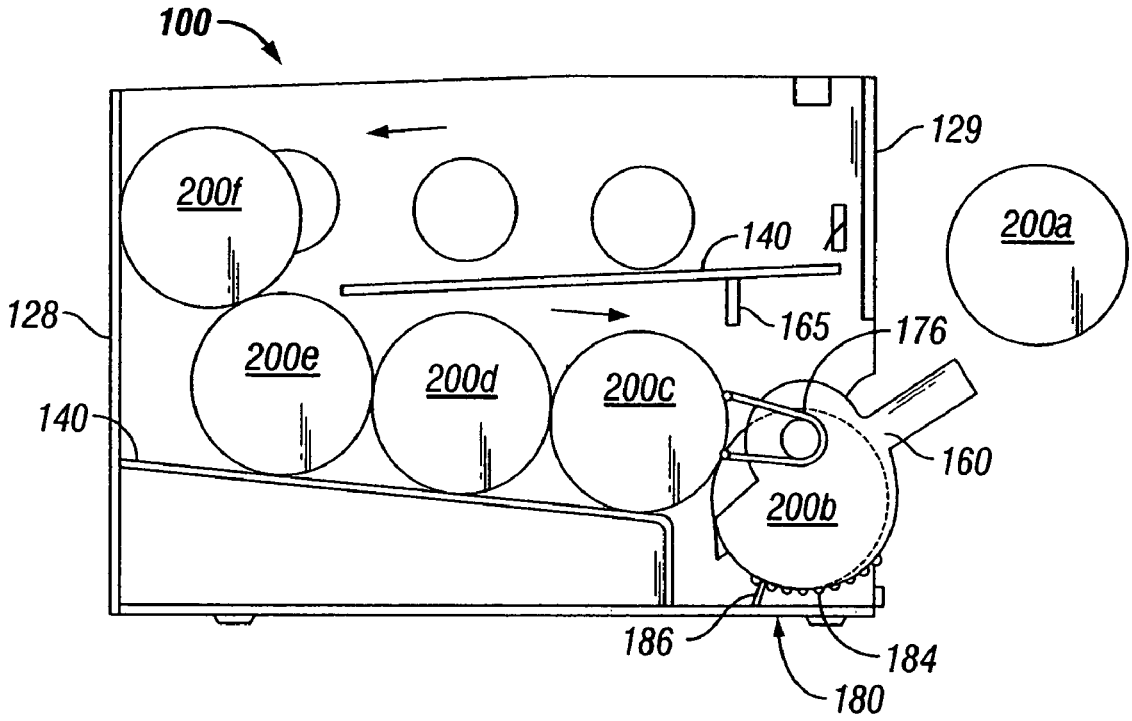
Figure 5:
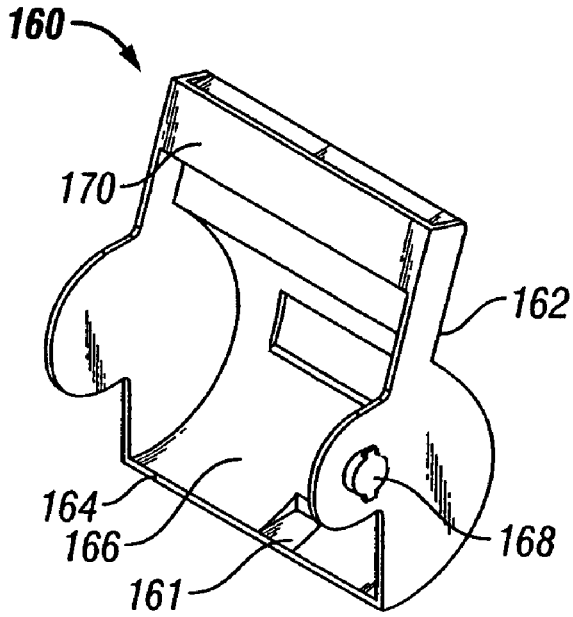
FIGS. 5 and 6 and perspective views of the door of the product merchandiser of FIG. 1.
Figure 6:
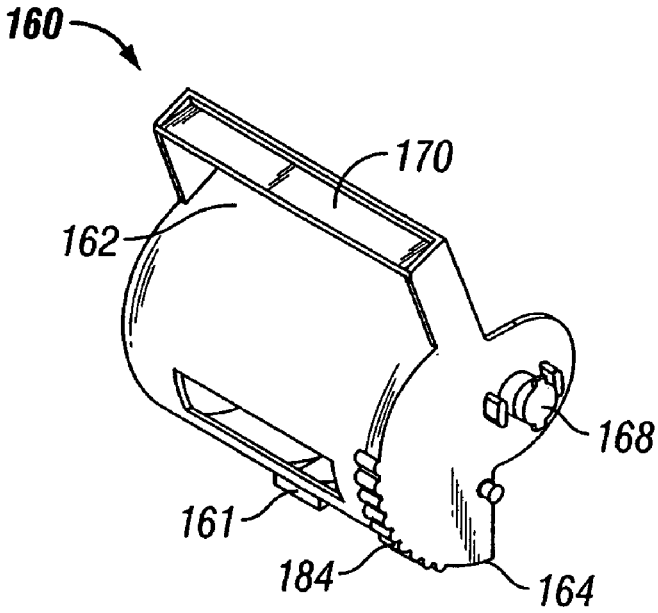

Referring now to FIGS. 5 and 6, door 160 has a proximal portion 162, a distal portion 164 and may also include a holding portion 166. The door 160 is disposed at least partially within the opening 134 of housing 120 (see FIGS. 1-4D). The door 160 may contain pivoting structure 168 enabling it to be pivotally connected to the housing 120. Pivoting structure 168 mechanically cooperates with an axle 136 on housing 120 to enable door 160 to swing from a first (closed) position to a second (open) position. Axle 136 may be in the form of an aperture or a set of apertures which receive pivoting structure 168 of door 160. A handle 170 may be included near proximal portion 162 of door 160 to facilitate moving door 160 between its first position and its second position.

Now referring to FIGS. 4A-4D, a plurality of products 200*a*-200*g* (lead product 200*a* and trailing products 200*b*-200*g*) are shown on track 140. (In FIG. 4D, lead product 200*a* is shown removed from product merchandiser 100 and other product 200*b* is shown in a lead product position. Other product 200*b* maintains its numerical designation of 200*b* for clarity, even though it is in a lead position.) FIGS. 4A and 4D illustrate when the door 160 is in its first position (closed); FIG. 4C illustrates when the door 160 is in its second position (open); and FIG. 4B illustrates when the door 160 is in between its first and second positions. The holding portion 172 of the door 160 may be disposed near the distal portion 164 of the door 160 and is dimensioned and configured to hold a product 200 therein. When the door 160 is in its first position (FIGS. 4A and 4D), it is able to receive a lead product 200*a* in its holding portion 172. When the door 160 is in its second position (FIG. 4C), the distal portion 164 of door 160 is elevated above the track 140 and prevents next product 200*b* on track 140 from moving proximally. Thus, only one product 200 can be dispensed from the product merchandiser 100 at a time.

Additionally, product merchandiser 100 is dimensioned and configured such that the next product 200*b* cannot be forced (e.g., by a thief) onto the door 160 or out of the product merchandiser 100 without the door 160 returning to its first position. A stop tab 165 (see FIGS. 2-4D) may also be disposed within housing 120 and positioned to ensure that the next product 200*b* cannot be prematurely removed from product merchandiser 100. Therefore, a thief would be prevented from removing a plurality of products 200 from the product merchandiser 100 while only creating a single sound.

Figure 2:
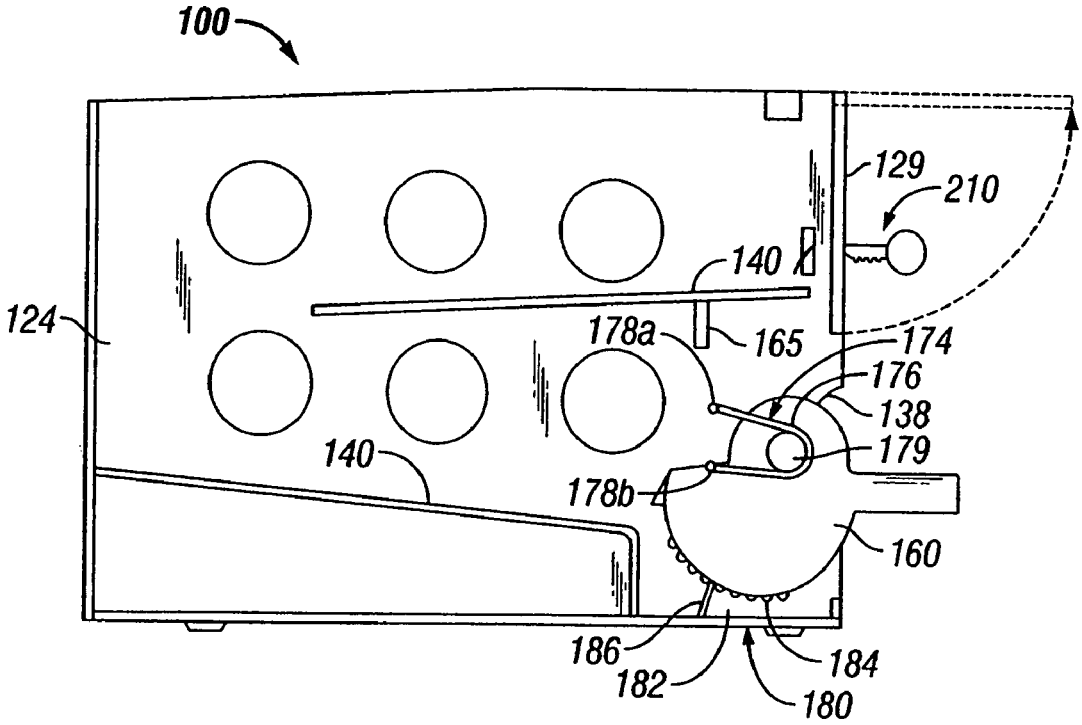
FIG. 2 is a side, cross-sectional view of the product merchandiser of FIG. 1.
Figure 3:
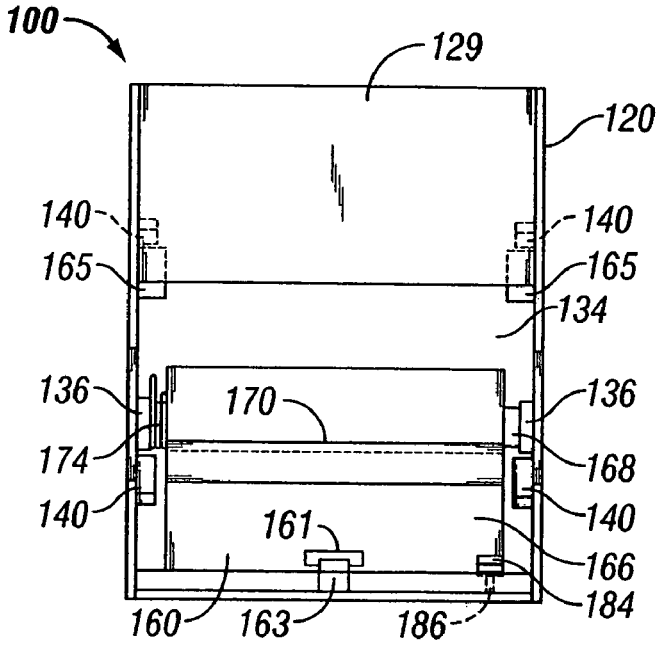
FIG. 3 is a front view of the product merchandiser of FIG. 1.

Door 160 may also be biased in its first position (i.e., closed) by a biasing device 174 (see FIG. 2). The biasing device 174 may include a cable 176 attached to two points 178*a*, 178*b* on housing 120 and may be wrapped around a biasing track 179 on the door 160. A stop member 161 may be disposed on the door 160 (see FIGS. 3, 5 and 6). The stop member 161 keeps the door 160 from moving past its first position (in the opposition direction of its second position) when it contacts a device 163 on the housing 120.

Sound-producing structure 180 may include a ratcheting system 182. The ratcheting system 182 may include groves 184 disposed on the door 160 and a flange 186 disposed on the housing 120 (shown in FIG. 2). It is also envisioned for grooves to be included on housing and a flange to be disposed on the door (not shown). When the door 160 is opened, the grooves 184 mechanically engage the flange 186 to produce a sound. The decibel range of the sound can be altered by, inter alia, adjusting the rigidity of the flange 186, adjusting the spacing of grooves 184 or altering the amount of flanges 186 and/or grooves 184 to suit the desired volume. It is also envisioned for a sound to be produced when the door 160 is moved from its second position to its first position.

Figure 7:
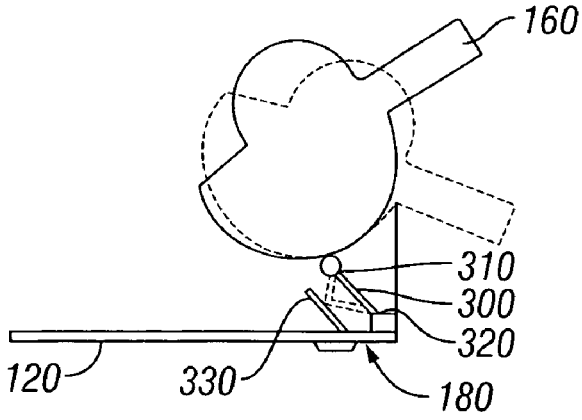
FIG. 7 is a side view of a sound-producing mechanism of the present disclosure.

Referring to FIG. 7, sound-producing structure 180 may include a spring 300. The spring 300 includes a top portion 310 secured to door 160 and a bottom portion 320 secured to housing 120. When the door 160 is in its first position, the spring 300 is generally straight and flat. The spring 300 may be in slight compression as a result of the way it is mounted and/or by design to apply an upward biasing force. As seen in dashed lines, when the door 160 is moved to its second position, the spring 300 is axially compressed until it snaps to a bent configuration (illustrated by dashed lines in FIG. 7). The spring 300 may be bi-stable, thus having two stable conditions between which it snaps. From this snapping action and/or from the spring 300 striking a surface 330 of housing 120, a noise occurs. This noise occurs each time the door 160 is moved from its first position to its second position and/or from its second position to its first position.

The housing 120 may also include detents 138 (see FIGS. 1, 2 and 4A-4D) disposed near its opening 134. Detents 138 may have a semi-circular shape and facilitate the removal of lead product 200*a*. When lead product 200*a* is on the holing portion 172 of the door 160 and when the door 160 is in its second position (i.e., door 160 is open), lead product 200*a* is capable of being removed from the product merchandiser 100. Detents 138 allow a customer's fingers to grab a larger portion of lead product 200*a*, thus making it easier to remove lead product 200*a* from product merchandiser 100.

The housing 120 may include a front portion 129 disposed between side walls 122, 124, near its proximal portion 126 and may be disposed over the opening 134. The front portion 129 may help to retain products 200 within the housing 120 and prevent a person from bypassing the door 160 to remove products 200. The front portion 129 may pivotally engage with the side walls 122, 124 of the housing 120 to allow the front portion 129 to open (illustrated by dashed lines in FIG. 2), thus providing access to inside of the product merchandiser 100. In such an embodiment, a lock 210 may be disposed on the front portion 129 of the housing 120 for only allowing access to an authorized person.

The product merchandiser 100 may be loaded with products 200 several ways, including, from upper portion 130, from distal portion 128, through door 160, through front portion 129, etc. The product merchandiser 100 may also be configured to allow a plurality of product merchandisers 100 to be stored next each other and/or stacked on top of each other.

While the above description contains many specifics, these specifics should not be construed as limitations on the scope of the present disclosure, but merely as exemplifications of preferred embodiments thereof. Those skilled in the art will envision many other possible variations that are within the scope and spirit of the claims appended hereto. For example, it is envisioned for a sound to be emitted when a product is removed from the door, rather than (or in addition to) the sound made when the door is opened (or when it reaches its second position. It is envisioned for an electro-mechanical sensor to be disposed within the housing for sensing when the door becomes ajar and for signaling a structure to produce a sound.

What is claimed is:

1. A product merchandiser which stores a plurality of products and which dispenses products one at a time, the product merchandiser comprising:

a housing including a proximal opening;

a track disposed within the housing to direct at least one product towards the proximal opening of the housing;

a door disposed near proximal opening of the housing, the door having a proximal portion and a distal portion, the door being pivotally connected to the housing for movement between a first position where a product is held at least partially within the housing and at least an adjacent second position where a product is removable from the housing; and a structure which produces a sound when the door is moved from its first position towards its second position, wherein the structure which produces a sound includes a ratcheting interface associated with the door and the housing, the ratcheting interface including a plurality of grooves and at least one flange, a first portion of the flange being stationary relative to the housing when the door is stationary and when the door is moving between its first position and its second position, and wherein a second portion of the flange is configured to contact a plurality of grooves when the door is moved between its first position and its second position, and wherein the flange extends upwardly from a bottom surface of the housing.

2. The product merchandiser according to claim 1 wherein the door includes a holding portion disposed near its distal portion, the holding portion holds a lead product at least partially within the housing.

3. The product merchandiser according to claim 2 wherein the track directs a product onto the holding portion of the door.

4. The product merchandiser according to claim 2 wherein the distal portion of the door rises with respect to the track when the door is moved from its first position to its second position, rising of the door blocks a product from moving proximally.

5. The product merchandiser according to claim 1 further including a structure which biases the door in its first position.

6. The product merchandiser according to claim 1 further including a handle disposed on the proximal portion of the door.

7. The product merchandiser according to claim 1 wherein the track is configured to direct products in a serpentine path.

8. The product merchandiser according to claim 1 wherein the housing further includes a front portion, the front portion being movable from an open position where it permits access to the track, to a closed position where it denies access to the track.

9. The product merchandiser according to claim 8 further including a lock operatively engaged with the front portion of the housing, the lock being capable of locking the front portion of the housing in a closed position.

10. The product merchandiser according to claim 1 wherein only one product is removable from the product merchandiser when the door is in its second position.

11. The product merchandiser according to claim 1 further including a stop tab disposed within the housing, the stop tab preventing a lead product from being removed from the product merchandiser, and the stop tab downwardly depending from a portion of the track towards the proximal opening of the housing.

12. The product merchandiser according to claim 1 wherein the door is free to move between its first and second positions when the door is at any location between its first and second positions.

13. The product merchandiser according to claim 1 wherein the structure which produces a sound when the door is moved from its first position to its second position also makes a sound when the door is moved from its second position to its first position.

14. The product merchandiser according to claim 1 wherein at least a majority of the grooves are disposed within the housing when the door is in its first position and when the door is in its second position.

15. The product merchandiser according to claim 1 wherein all of the grooves are disposed within the housing when the door is in its second position.

16. A product merchandiser which stores a plurality of products and which dispenses products one at a time, the product merchandiser comprising:

a housing including a proximal opening and a surface;

a door disposed near proximal opening of the housing, the door having a proximal portion and a distal portion, the door being pivotally connected to the housing for movement between a first position where a product is held at least partially within the housing and at least a second position where a product is removable from the housing; and a structure which produces a sound when the door is moved between its first position and its second position, wherein the structure which produces a sound includes a spring, the spring being connected to the housing and the door for movement between a first position where the spring is generally flat and a second position where the spring is compressed and includes a bent portion having an apex between two legs of the spring, wherein the apex of the spring contacts the surface of the housing when the spring is compressed.

17. The product merchandiser according to claim 16 wherein the housing includes a lower portion, the lower portion being sloped towards the proximal opening of the housing.

18. The product merchandiser according to claim 16 wherein products stored therein are directed to the proximal opening of the housing via gravity.

19. The product merchandiser according to claim 16 wherein the products stored therein are stored in a tumbled arrangement.

* * * * *